US005503563A

United States Patent [19]

Abe

[11] Patent Number: 5,503,563

[45] Date of Patent: Apr. 2, 1996

[54] CONNECTOR COVER

[75] Inventor: Yukiyasu Abe, Yokkaichi, Japan

[73] Assignee: Sumimoto Wiring Systems, Ltd., Mie, Japan

[21] Appl. No.: 166,826

[22] Filed: Dec. 15, 1993

[30] Foreign Application Priority Data

Jan. 13, 1993 [JP] Japan ..... 5-003779 U

[51] Int. Cl.[6] ..... H01R 13/44

[52] U.S. Cl. ..... 439/136

[58] Field of Search ..... 439/135, 136, 439/142, 144, 147, 149, 718

[56] References Cited

U.S. PATENT DOCUMENTS

| | | | |
|---|---|---|---|
| 2,062,752 | 12/1936 | Kindberg | 439/136 X |
| 4,060,297 | 11/1977 | Marshall et al. . | |
| 4,333,698 | 6/1982 | Herbert . | |
| 4,435,032 | 3/1984 | Abramson et al. | 439/136 |
| 4,731,032 | 3/1988 | Noorily | 439/136 |
| 4,846,318 | 7/1989 | Groves | 439/368 X |

FOREIGN PATENT DOCUMENTS

| | | |
|---|---|---|
| 1221149 | 4/1987 | Canada . |
| 8218120 | 1/1983 | Germany . |
| 61-10308 | 4/1986 | Japan . |

*Primary Examiner*—Khiem Nguyen
*Attorney, Agent, or Firm*—Oliff & Berridge

[57] ABSTRACT

A connector cover has a simple type of lock device and positively protects a connector. The connector cover includes a cover body having a cover-side projection that is engageable with a projection on a connector housing to prevent removal of the connector cover. Manipulation pieces extend from the cover body. With this construction, by holding the manipulation pieces, that portion of the cover body around the projection is elastically deformed, so that the engagement of the projection with the housing-side projection is released.

12 Claims, 2 Drawing Sheets

CONNECTOR COVER

BACKGROUND OF THE INVENTION

This invention relates to a connector cover, and more particularly, to a connector cover having an improved locking arrangement enabling a secure connection and easy disengagement.

FIGS. 3 and 5 show a conventional male connector and a conventional female connector used in an engine room of an automobile. The two connectors 1 and 16 are fitted together in an automobile-assembling line. Before this fitting is done, terminals of the male connector are exposed, and therefore, some dust-prevention/waterproof device must be provided. In view of this, the female connector 16 has heretofore been used to serve also as a protective cover. By thus utilizing the female connector 16, the two connectors 1 and 16 can be freely connected together and disconnected from each other, when necessary, by a locking device of the female connector 16.

However, before wires are inserted into the female connector 16, wire insertion ports 17 are in an open condition. Therefore, in this condition, dust and water are allowed to enter the wire insertion ports. Therefore, a packing of rubber called a "dummy plug" is placed in each wire insertion port. Such an operation is not only cumbersome, but also lowers the efficiency of the operation and increases cost.

Another problem encountered when the female connector 16 is used as a protective cover is that when there is conducted a test (bench test or the like), in which water is applied to the connector, the water collects in recesses 18, which are formed in the connector in the vicinity of the insertion ports for the purpose of reducing the weight of the connector. Therefore, even if the intrusion of water into the connector is prevented, there is a possibility that water collected in recesses 18 will be introduced into the male connector when the female connector is disconnected.

A relatively strong locking force is required for locking the two connectors relative to each other, and usually, an elastic retaining piece 19 formed on the female connector 16 is elastically deformed and is engaged with a projection 8 on the male connector, thereby obtaining a locking force from the elastic retaining piece. The elastic retaining piece 19 includes a portion 19*a* for pushing the elastic retaining piece 19, a retaining portion 19*b* formed at a distal end thereof, and a hinge portion for flexing the retaining portion. This locking device has a complicated construction and is costly for the disposable protective cover.

SUMMARY OF THE INVENTION

The present invention has been made in view of the above problems, and an object of the invention is to provide a connector cover that has a simple type of locking device and that positively protects the connector.

It is another object of the invention to provide a special protective cover with a less rugged outer surface in order to solve the above problems. A requirement to be met when such a protective cover is provided is that the attached protective cover is removable. Also, the protective cover need only to be attached before the female and male connectors are fitted together. In view of these, it is advantageous that a locking device for the male connector should be as simple as possible from the viewpoint of the manufacture of a mold for the protective cover.

The above objects have been achieved by providing a connector cover attached to an open portion of a connector housing having terminals mounted therein. A cover body of a synthetic resin has an engagement device for engagement with an engagement portion on the connector housing to prevent removal of the cover body. Manipulation pieces extend from the cover body, wherein by holding the manipulation pieces, that portion of the cover body around the engagement device is elastically deformed to release the engagement of the engagement device with the engagement portion.

DETAILED DESCRIPTION OF PREFERRED EMBODIMENTS

Figure 1:
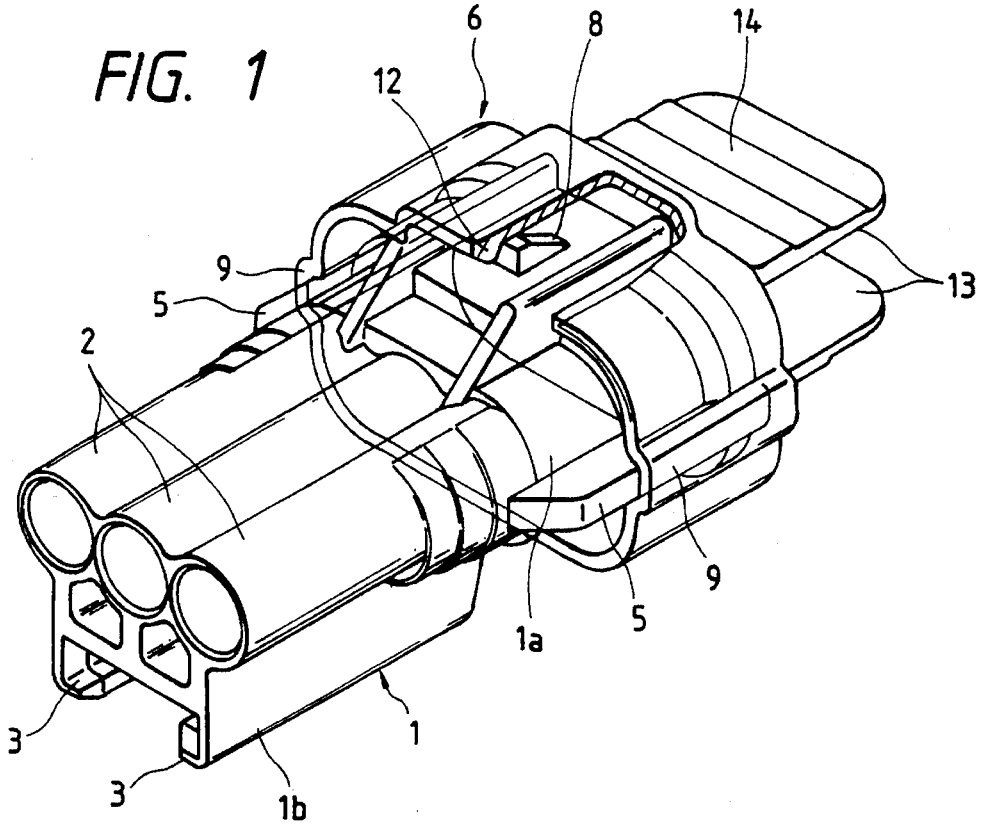
FIG. 1 is a perspective view of a connector cover, showing the condition of use thereof.
Figure 2:
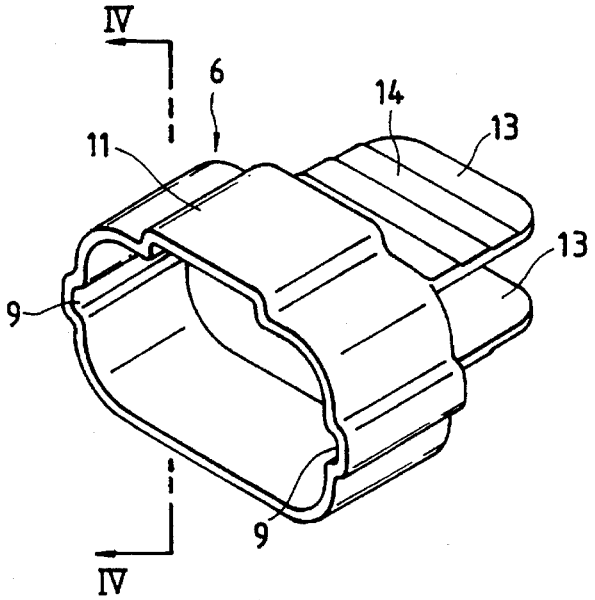
FIG. 2 is a perspective view of a cover body.
Figure 4:
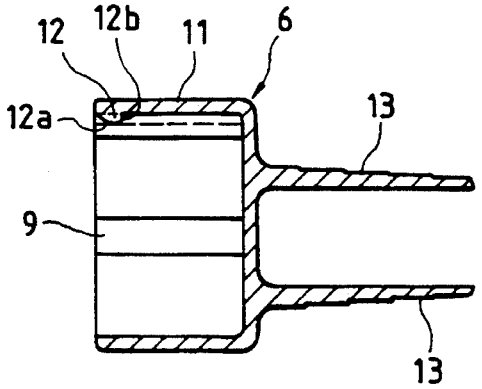
FIG. 4 is a cross-sectional view taken along the line IV—IV of FIG. 2.
Figure 3:
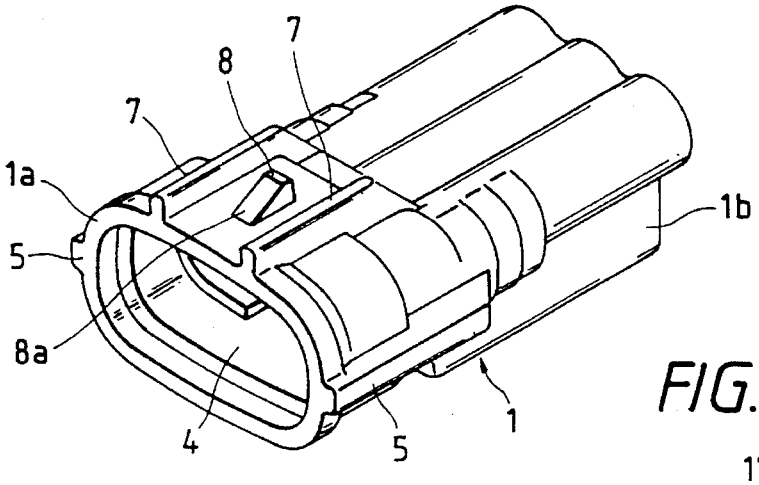
FIG. 3 PRIOR ART
FIG. 3 is a perspective view of a conventional male connector housing.
Figure 5:
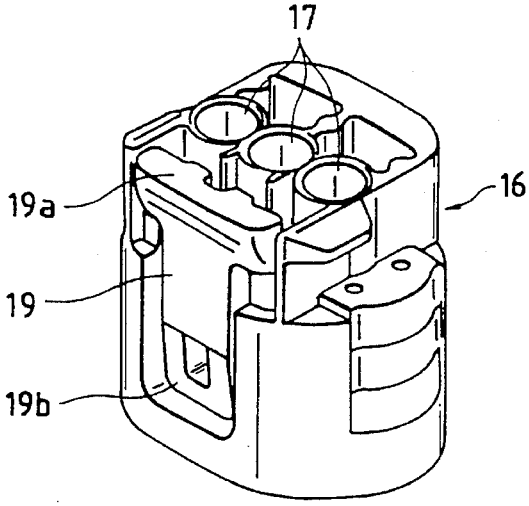
FIG. 5 PRIOR ART
FIG. 5 is a perspective view of a conventional female connector housing.

A preferred embodiment of the present invention will now be described with reference to the drawings. Reference is first made to a male connector (see FIG. 3) to which a connector cover of this embodiment is to be attached. A connector housing 1 is integrally molded of a synthetic resin, and a generally front half thereof is a connection portion 1*a* for connection to a female connector. A fixing portion 1*b* for fixing the connector to the connector housing 1 is provided at a rear half thereof.

Three wire insertion tubes 2 are formed on an upper portion of the fixing portion 1*b*. Tubes 2 are juxtaposed to one another and are partitioned from one another. A pair of opposed clamp pawls 3 for elastically engaging a fixing member (not shown) are formed on a lower portion of the fixing portion 1*b*.

A generally oval opening 4 for connection to the female connector (not shown) is formed in an end face of the connection portion 1*a*, and a plurality of male terminals (not shown) are provided within the connection portion 1*a*. Guide protuberances 5 are formed respectively on the opposite (right and left in FIG. 3) side surfaces of the connection portion 1*a* and extend along a length thereof. These guide protuberances serve to guide the female connector (not shown) and a cover body 6 (later described) during the fitting operation. A pair of (right and left in FIG. 3) parallel, spaced ridges 7 are formed on the upper surface of the connection portion 1*a* and extend along the length thereof. A retaining projection 8 for the cover body 6 and the female connector is formed on the upper surface of the connection portion 1*a* and is disposed between the two ridges 7. A front surface of projection 8 is formed into a slanting surface 8*a* slanting upwardly along the fitting direction, and a rear end surface of projection 8 is substantially vertical.

The cover body 6 of the connector cover is integrally molded of a synthetic resin having a suitable degree of elasticity and is generally in the form of a short tube only one end of which is open. The open end of the cover body 6 corresponds in shape to the oval opening 4 in the connection portion 1*a* and elastically fits on connection portion 1*a*. Guide grooves 9, corresponding respectively to the two guide protuberances 5 of connection portion 1*a*, are formed in the opposite (right and left) side walls of cover body 6, respectively, and these groove portions are provided in a bulged manner. Guide protuberances 5 can be fitted respectively in the guide grooves 9 in such a manner that each guide protuberance 5 is disposed generally in contact with the inner surface of the corresponding guide groove 9. A generally table-shaped bulge portion 11 for receiving the two ridges 7 is formed on the upper wall of the cover body 6.

A projection 12, which is engageable with the projection (housing-side projection) 8, is formed on the inner surface of the bulge portion 11 at the edge portion of the open end. A front surface of the cover-side projection 12 is formed into a slanting surface 12*a*, slanting downwardly along the fitting direction. Slanting surface 12*a* can be brought into sliding contact with the slanting surface 8*a* of the projection 8 on the housing so that the fitting operation can be effected smoothly. A rear surface of the cover-side projection 12 serves as a retaining surface 12*b*, which is engageable with the rear end surface of the housing-side projection 8 substantially in alignment therewith.

A pair of upper and lower manipulation pieces 13 for releasing the engagement between the two projections 8 and 12 are formed on the rear surface of the cover body 6. Each of the two manipulation pieces 13 is in the form of a flat plate, and the two manipulation pieces are spaced an appropriate distance from each other in an upward-downward direction and extend horizontally from the cover body. By holding these manipulation pieces, the upper wall (the bulge portion 11) and the lower wall of the cover body 6 are elastically deformed to bulge away from each other at the open end of the cover body, thereby releasing the engagement between the two projections 8 and 12. A plurality of steps 14 for anti-slip purposes are formed on the surface of each of the two manipulation pieces 13.

With the above construction of the connector cover of this embodiment, the open end of the cover body 6 is brought into registry with the oval opening 4 of the male connector housing 1, and the connector cover is fitted on the connector housing so that the two slanting surfaces 8*a* and 12*a* of the housing-side projection 8 and the cover-side projection 12 are brought into sliding contact with each other. The retaining surface 12*b* becomes engaged with the rear end surface of the housing-side projection 8. As a result, the cover body 6 is attached to the male connector housing 1 and is retained against disengagement therefrom.

In contrast, when the cover body 6 is to be removed, the two manipulation pieces 13 are held from the upper and lower sides. As a result, the upper and lower walls of the cover body 6 are pulled toward the manipulation pieces 13 to be elastically deformed upwardly and downwardly, respectively. As a result, the engagement between the two projections 8 and 12 is released, so that the cover body 6 can be easily removed from the connector housing 1.

In the present invention, the conventional housing-side projection 8 is utilized as the lock means for locking the cover body 6 relative to the connector housing 1. The projection 12, engageable with housing-side projection 8, is formed on the cover body 6. Therefore, a simple lock means is achieved, and a mold for molding the cover body 6 can be simplified. The manipulating force for the manipulation pieces 13 to effect the disengagement can be reduced as much as possible. As a result, the retaining force can be set to a higher level, thereby providing an advantage in that disengagement of the cover body 6 is effectively prevented. In this embodiment, the manipulation pieces are provided in the direction of the length of the connector housing, and with this arrangement, there is provided an advantage in that there is a space for mounting the connector. For example, a certain degree of space is available in the direction of the length of the connector housing in an engine room, but a sufficient space may not be available in the direction of the width of the connector housing. The connector cover of this embodiment is advantageously mounted at such a location.

Alternatively, the connector body can be formed without the manipulation pieces 13, in which engagement is released by holding the cover body 6.

Figure 6:
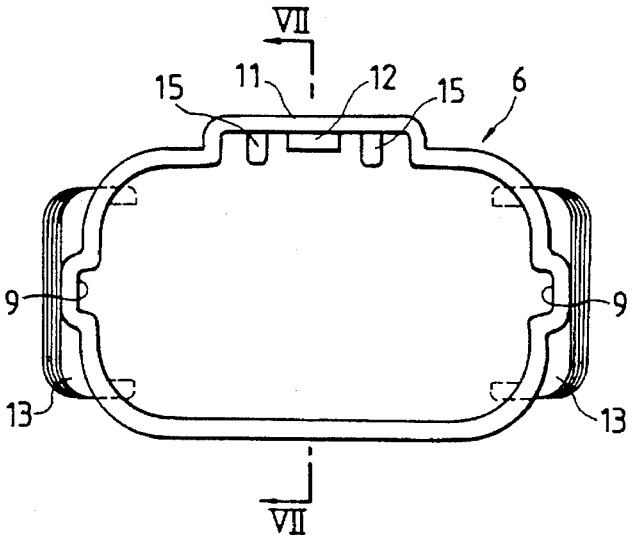
FIG. 6 is a front-elevational view of a second embodiment of a cover body.
Figure 7:
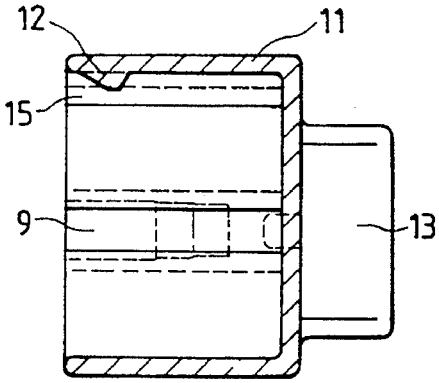
FIG. 7 is a cross-sectional view taken along the line VII—VII of FIG. 6.

FIGS. 6 and 7 show a second embodiment of the present invention. In this embodiment, manipulation pieces 13 are disposed perpendicular to those of the first embodiment, and the direction of holding the manipulation pieces is perpendicular to the direction of the elastic deformation of cover body 6. More specifically, the manipulation pieces 13 extend from rear edges of opposite (right and left in FIG. 6) side walls of the cover body 6. Each of the manipulation pieces 13 is of a U-shape, which is open inwardly. By holding these manipulation pieces, a pushing force is applied to the opposite side walls of the cover body 6, so that upper and lower walls of the cover body 6 are elastically deformed to bulge away from each other. A pair of ridges 15 are formed on an inner surface of bulge portion 11, with a cover-side projection 12 disposed therebetween. When the cover body 6 is attached to the connector housing 1, the ridges 15 are interposed between the two ridges 7 of the connector housing 1.

The above construction of the second embodiment is generally identical to that of the first embodiment except that the direction of manipulation of the manipulation pieces is different, and similar effects are achieved.

The cover body is kept attached to the connector housing, with the engagement means engaged with the engagement portion. For removing the cover body, the manipulation pieces are manipulated, so that the cover is deformed in a predetermined direction, that is, a direction to release the engagement between the engagement means and the engagement portion, and therefore the cover body can be easily removed.

The cover body is retained relative to the connector housing merely through the engagement between the engagement means and the engagement portion, so that the cover body is kept attached to the connector housing. Thus, the lock means for the cover is simple in construction and is compact. The manipulation pieces enable the disengagement of the cover body to be achieved with a low manipulation force.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A connector cover removably attachable to an open portion of an electrical connector housing, the connector cover comprising:

a cover body having an engagement projection engagable with a corresponding projection on said connector housing; and at least two manipulation pieces fixed to said cover body and extending from said cover body;

wherein when said at least two manipulation pieces are urged together, said cover body elastically deforms to thereby disengage said engagement projection from said corresponding projection.

2. A connector cover according to claim 1, wherein said connector housing comprises a pair of guide protuberances, said cover body comprising a pair of guide grooves for receiving said guide protuberances.

3. A connector cover according to claim 1, wherein said connector housing comprises a pair of spaced ridges disposed on an upper surface of said connector housing and delimiting a space, said corresponding projection being disposed in said space between said ridges, wherein said cover body comprises a bulge portion for receiving said ridges, said engagement projection being disposed in said bulge portion.

4. A connector cover according to claim 3, wherein said corresponding projection comprises an inclined surface and a vertical surface, said engagement projection comprising a corresponding inclined surface and vertical surface such that said inclined surfaces guide said engagement projection to engage its vertical surface with the vertical surface of said corresponding projection.

5. A connector cover according to claim 4, wherein said connector cover comprises a pair of manipulation pieces spaced about a central portion of said cover body and extending horizontally from said cover body and parallel to one another, and wherein when said manipulation pieces are urged together, said cover body is elastically deformed to thereby disengage said engagement projection from said corresponding projection.

6. A connector cover according to claim 1, wherein said connector cover comprises a pair of manipulation pieces spaced about a central portion of said cover body.

7. A connector cover according to claim 6, wherein respective outer surfaces of said manipulation pieces are anti-slip surfaces.

8. A connector cover according to claim 1, wherein said cover body is made from a flexible resin material.

9. A connector cover according to claim 1, wherein said connector cover comprises a pair of manipulation pieces disposed on opposite sides of said cover body, and wherein when said manipulation pieces are urged toward each other, said cover body is elastically deformed to thereby disengage said engagement projection from said corresponding projection.

10. A connector cover according to claim 9, wherein said manipulation pieces are U-shaped.

11. A connector cover according to claim 9, wherein said connector housing comprises a pair of spaced first ridges disposed on an upper surface of said connector housing, wherein said cover body comprises a bulge portion for receiving said first ridges and a pair of second ridges engagable with said first ridges, said engagement projection being disposed in said bulge portion between said second ridges.

12. A connector cover removably attachable to an open portion of an electrical connector housing, the connector cover comprising:

a cover body having an engagement projection engagable with a corresponding projection on said connector housing; and means comprising at least two manipulation pieces for elastically deforming said cover body to thereby disengage said engagement projection from said corresponding projection.

* * * * *